US008467710B2

(12) United States Patent
Suzuki

(10) Patent No.: US 8,467,710 B2
(45) Date of Patent: Jun. 18, 2013

(54) IMAGE FORMING APPARATUS FOR CONTROLLING FIXING OF TONER ON A PAPER AND CONTROLLING COOLING OF THE PAPER BASED ON A CONVEYANCE PATH TO WHICH THE PAPER IS TO BE CONVEYED

(75) Inventor: Chikatsu Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 283 days.

(21) Appl. No.: 12/897,143

(22) Filed: Oct. 4, 2010

(65) Prior Publication Data

US 2011/0085830 A1 Apr. 14, 2011

(30) Foreign Application Priority Data

Oct. 9, 2009 (JP) ..... 2009-235046

(51) Int. Cl.
*G03G 15/20* (2006.01)

(52) U.S. Cl.
USPC ..... 399/322; 399/329; 399/341

(58) Field of Classification Search
USPC ..... 399/67, 68, 322, 328, 329, 341
See application file for complete search history.

(56) References Cited

U.S. PATENT DOCUMENTS

2008/0166161 A1* 7/2008 Washino et al. ..... 399/329

FOREIGN PATENT DOCUMENTS

JP 2005-316046 A 11/2005
JP 2007-148430 A 6/2007

* cited by examiner

*Primary Examiner* — Hoang Ngo
(74) *Attorney, Agent, or Firm* — Holtz, Holtz, Goodman & Chick, P.C.

(57) ABSTRACT

Disclosed in an image forming apparatus including a conveyance section to convey a paper, a first fixing device to fix a toner on the paper by heat fixing, a first cooling device to cool the paper in which the toner is fixed, a second fixing device to fix the toner on the paper by heat fixing, a second cooling device to cool the paper in which the toner is fixed, a conveyance path switching section to switch a conveyance path of the paper between a first conveyance path and a second conveyance path and a control section to control so as to carry out cooling by operating the second cooling device and not operating the first cooling device when the paper is to be conveyed to the first conveyance path and so as to carry out cooling by operating the first cooling device when the paper is to be conveyed to the second conveyance path.

14 Claims, 5 Drawing Sheets

IMAGE FORMING APPARATUS FOR CONTROLLING FIXING OF TONER ON A PAPER AND CONTROLLING COOLING OF THE PAPER BASED ON A CONVEYANCE PATH TO WHICH THE PAPER IS TO BE CONVEYED

BACKGROUND OF THE INVENTION

1. Field of the Invention

The present invention relates to an image forming apparatus.

2. Description of Related Art

A fixing device is an important component which constitutes an image forming apparatus and is a part necessary for fixing toner to a paper. Usually, only one fixing device is provided per one image forming apparatus. However, there is a case where two fixing devices are provided in one image forming apparatus. Reasons for providing two fixing devices in one image forming apparatus is for assuring sufficient fixation and for improving gloss (gloss level) of an image, for example.

As for the image forming apparatus in which two fixing devices are provided, there are conventional arts shown bellow, for example.

In JP 2005-316046, there is disclosed an image forming apparatus in which a cooling device is provided between the first fixing device and the second fixing device and thereby gloss change of an image is controlled to prevent degradation of image quality.

In JP 2007-148430, there is disclosed an image forming apparatus which obtains a good gloss image without greatly increasing power consumption by controlling the set temperature of the first fixing device, in a case where fixing is carried out by using both of the first fixing device and the second fixing device, so as to be lower than the set temperature of when fixing is carried out by only using the first fixing device.

However, the arts disclosed in JP 2005-316046 and JP 2007-148430 are arts for preventing degradation in image quality due to gloss of an image by controlling the heating temperature of the fixing devices.

A problem with providing a plurality of fixing devices is that the toner on the paper which passed the first fixing device is heated and softened and that roller marks, scratch marks and the like are formed at contacting positions by the toner which is in the softened state contacting with a conveyance roller, a conveyance path switching nail and the like.

In JP 2005-316046 and JP 2007-148430, there is no description or teaching regarding degradation of image quality due to the roller marks, scratch marks and the like.

SUMMARY OF THE INVENTION

An object of the present invention is to provide an image forming apparatus which assures sufficient fixation or which improves gloss of an image, and further which can prevent degradation in image quality which may occur during conveyance.

To achieve the abovementioned object, according to a first aspect of the present invention, there is provided an image forming apparatus including a conveyance section to convey a paper in which a toner image which is not fixed is formed, a first fixing device to fix a toner on the paper by heat fixing, a first cooling device to cool the paper in which the toner is fixed by heat fixing, which is disposed in a downstream side in a paper conveyance direction than the first fixing device, a second fixing device to fix the toner on the paper by heat fixing, which is disposed in the downstream side in the paper conveyance direction than the first cooling device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first cooling device and the second fixing device and a control section to control so as to carry out cooling by operating the second cooling device and not operating the first cooling device when the paper is to be conveyed to the first conveyance path and so as to carryout cooling by operating the first cooling device when the paper is to be conveyed to the second conveyance path.

Further, according to a second aspect of the present invention, there is provided an image forming apparatus including a conveyance section to convey a paper in which a toner image which is not fixed is formed, a first fixing device to fix a toner on the paper by heat fixing, a second fixing device to fix the toner on the paper by heat fixing, which is disposed in a downstream side in a paper conveyance direction than the first fixing device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first fixing device and the second fixing device, a first cooling device to cool the paper in which the toner is fixed by heat fixing, which is disposed in the downstream side in the paper conveyance direction than the conveyance path switching section of the second conveyance path and a control section to control so as to carry out cooling by operating the second cooling device when the paper is to be conveyed to the first conveyance path and so as to carry out cooling by operating the first cooling device when the paper is to be conveyed to the second conveyance path.

Furthermore, according to a third aspect of the present invention, there is provided an image forming system including a conveyance section to convey a paper in which a toner image which is not fixed is formed, a first fixing device to fix a toner on the paper by heat fixing, a first cooling device to cool the paper in which the toner is fixed by heat fixing, which is disposed in a downstream side in a paper conveyance direction than the first fixing device, a second fixing device to fix the toner on the paper by heat fixing, which is disposed in the downstream side in the paper conveyance direction than the first cooling device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first cooling device and the second fixing device and a control section to control so as to carry out cooling by operating the second cooling device and not operating the first cooling device when the paper is to be conveyed to the first conveyance path and so as to carry out cooling by operating the first cooling device when the paper is to be conveyed to the second conveyance path.

Moreover, according to a fourth aspect of the present invention, there is provided an image forming system including a conveyance section to convey a paper in which a toner image which is not fixed is formed, a first fixing device to fix a toner on the paper by heat fixing, a second fixing device to fix the toner on the paper by heat fixing, which is disposed in a downstream side in a paper conveyance direction than the first fixing device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first fixing device and the second fixing device, a first cooling device to cool the paper in which the toner is fixed by heat fixing, which is disposed in the downstream side in the paper conveyance direction than the conveyance path switching section of the second conveyance path and a control section to control so as to carry out cooling by operating the second cooling device when the paper is to be conveyed to the first conveyance path and so as to carry out cooling by operating the first cooling device when the paper is to be conveyed to the second conveyance path.

BRIEF DESCRIPTION OF THE DRAWINGS

The present invention will become more fully understood from the detailed description given hereinbelow and the appended drawings, and thus are not intended as a definition of the limits of the present invention, and wherein.

DESCRIPTION OF THE PREFERRED EMBODIMENT

The structure and operation of an image forming apparatus according to the embodiment will be described in detail with reference to the drawings. Here, the present invention is not limited to the embodiment. For example, a color image forming apparatus is exemplified and described in the embodiment. However, the present invention can also be implemented by a monochrome image forming apparatus.

Figure 1:
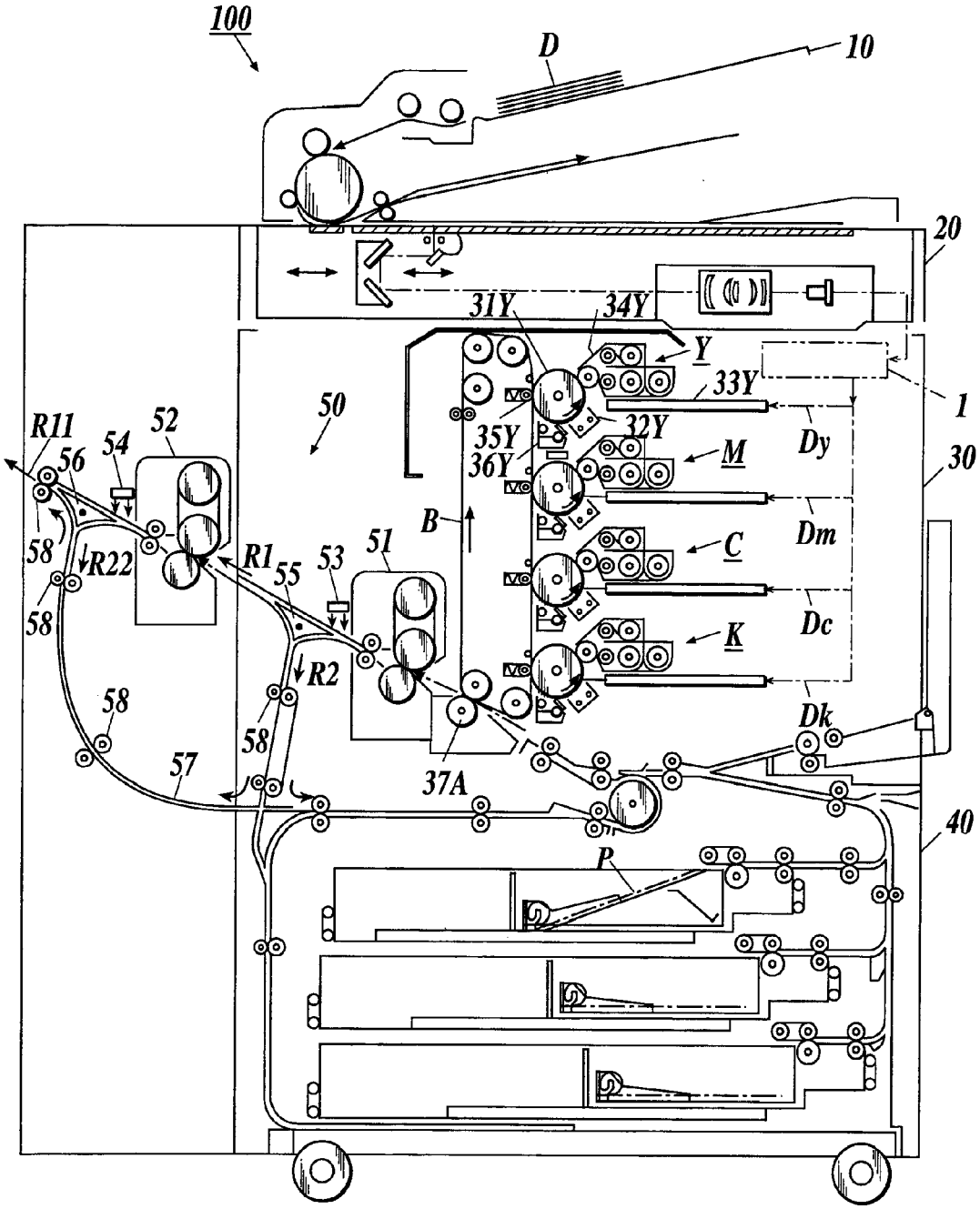
FIG. 1 is a schematic diagram of an image forming apparatus.

A configuration of a color image forming apparatus 100 is shown in FIG. 1.

The image forming apparatus 100 includes an automatic document conveyance section 10, a scanner section 20, an image forming section 30, a paper feeding section 40, a fixing unit 50 and the like.

The automatic document conveyance section 10 includes a mounting tray for mounting a document D, a plurality of conveyance rollers for conveying the document D and the like, and the automatic document conveyance section 10 conveys the document D to a predetermined conveyance path.

The scanner section 20 irradiates light to the document D which is conveyed or the document D which is mounted on a platen glass, and the scanner section 20 receives the reflection light which is reflected from the document D. The scanner section 20 converts the received light signal to an electronic signal and outputs the converted electronic signal to the control section 1.

Figure 2:
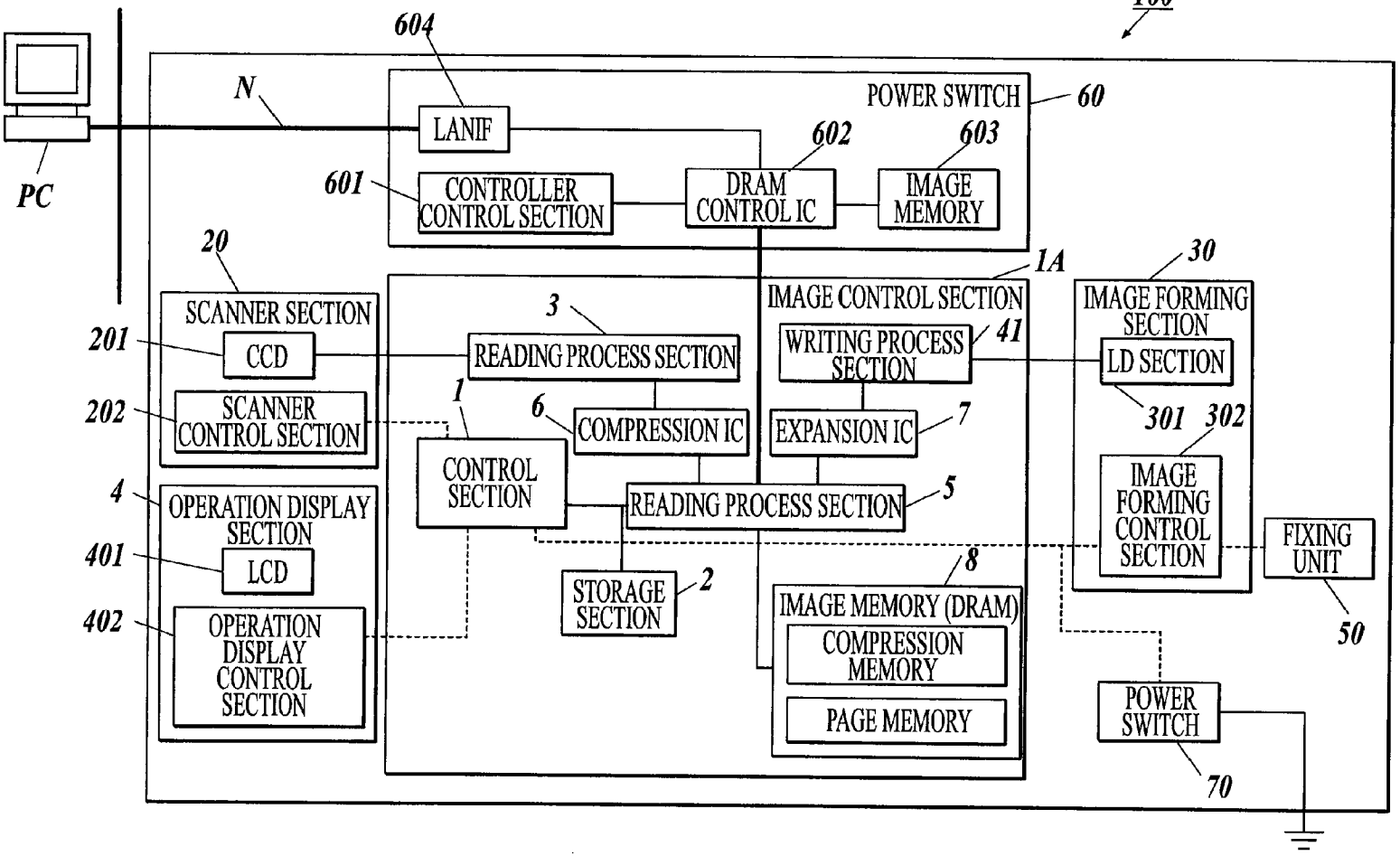
FIG. 2 is a functional structural diagram of the image forming apparatus.

Here, the control section 1 inputs the outputted electronic signal and outputs the inputted electronic signal to each part of the image control section which is not shown (see FIG. 2). The image control section carries out various types of image processes by inputting the electronic signals and generates image data Dy, Dm, Dc and Dk respectively for each of the colors YMCK. The control section 1 outputs the generated image data Dy, Dm, Dc and Dk of each color of YMCK to the image forming section 30.

The image forming section 30 includes a yellow imaging section Y, a magenta imaging section M, a cyan imaging section C, a black imaging section K and the like.

The yellow imaging section Y includes a photosensitive drum 31Y, a charging device 32Y, an exposure device 33Y, a development device 34Y, a transfer roller 35Y, a cleaning device 36Y and the like.

The yellow imaging section Y uniformly charges the surface of the photosensitive drum 31Y by the charging device 32Y. Further, the yellow imaging section Y inputs the image data Dy which is outputted from the control section 1 and forms an electrostatic latent image on the photosensitive drum 31Y by the exposure device 33Y based on the inputted image data Dy.

The yellow imaging section Y forms a yellow toner image on the photosensitive drum 31Y by the development device 34Y based on the formed electrostatic latent image. The yellow imaging section Y transfers (primary transfer) the formed yellow toner image to the transfer belt B by the transfer roller 35Y. The yellow imaging section Y removes residual toner remaining on the photosensitive drum 31 after the primary transfer by the cleaning device 36Y.

The magenta imaging section M, the cyan imaging section C and the black imaging section K have a structure similar to the above described yellow imaging section Y and operate similarly to the above described yellow imaging section Y. Therefore, the descriptions will be omitted.

Each of the imaging sections of YMCK respectively transfers a toner image of each color of YMCK to the transfer belt B. Thereby, a color toner image is to be formed on the transfer belt B.

The transfer roller 37 transfers (secondary transfer) the toner image of each color of YMCK which is formed on the transfer belt B on a paper P which is conveyed from the paper feeding section 40.

The paper feeding section 40 includes a plurality of trays, and plurality of papers P, which are different types, are respectively housed in each of the trays. The paper feeding section 40 feeds the housed paper P to the image forming section 30 by a predetermined conveyance path.

Further, the image forming apparatus 100 includes the fixing unit 50.

The fixing unit 50 includes a first fixing device 51, a second fixing device 52, a first cooling device 53, a second cooling device 54, a first conveyance path switching section 55, a second conveyance path switching section 56, a conveyance path 57, a conveyance roller 58 and the like.

The first fixing device 51 includes a heating roller, a pressurizing roller, a fixing belt and the like. The first fixing device 51 heats and pressurizes the paper P which is conveyed and fixes the toner image formed on the paper P to the paper P by heat fixing.

The second fixing device 52 also has a structure similar to the first fixing device 51 and operates similarly to the first fixing device 51.

The first cooling device 53 includes a fan and the like and the first cooling device 53 is disposed at downstream side in the conveyance direction of the paper P than the first fixing device 51. The first cooling device 53 can be switched between cooling and not-cooling by ON/OFF of a fan or by controlling the airflow of the fan, and cools the paper P, which is conveyed, by air blow. The first cooling device 53 can prevent roller marks being formed on the paper P during conveyance, for example, by cooling the toner which is heated by the first fixing device 51 and solidifying the toner.

Here, the first cooling device 53 may be structured so as to include a shutter between the fan and the paper P. In such case, the first cooling device 53 can be switched between cooling and not-cooling the paper P, which is conveyed, by opening and closing the shutter.

The second cooling device 54 has a structure similar to the first cooling device 53 and operates similarly to the first cooling device 53.

The first conveyance path switching section 55 is a switching nail for switching the conveyance path of the paper P which is ejected from the first fixing device 51 and cooled by the first cooling device 53. For example, the first conveyance path switching section 55 switches the conveyance path of the paper P to path R1 or path R2.

The path R1 is a conveyance path to convey the paper P to the second fixing device 52.

The path R2 is a conveyance path (conveys downward and then to left) to eject the paper P outside of the apparatus or a conveyance path (conveys downward and then to right) to reverse the paper P and carry out image forming to the paper P again.

Here, when the toner and the first conveyance path switching section 55 contact each other when the toner on the paper P is heated and is in a softened state, a roller mark and a scratch mark are to be formed.

The second conveyance path switching section 56 is a switching nail for switching the conveyance path of the paper P which is ejected from the second fixing device 52 and cooled by the second cooling device 54. For example, the second conveyance path switching section 56 switches the conveyance path of the paper P to path R11 or path R22.

The path R11 is a conveyance path to eject the paper P outside of the apparatus.

The path R22 is a conveyance path to reverse the paper P and carry out image forming to the paper P again.

Here, when the toner and the second conveyance path switching section 56 contact each other when the toner on the paper P is heated and is in a softened state, a roller mark and a scratch mark are to be formed.

The conveyance path 57 includes a portion of or all of the above described path R1, path R2, path R11 and path R22, and the conveyance path 57 is a conveyance path to convey the paper P to a predetermined position.

The conveyance rollers 58 include rollers which are rotationally driven, and the conveyance rollers 58 convey the paper P which is on the conveyance path 57 by contacting the paper P and by being rotationally driven.

Here, when the toner and the conveyance rollers 58 contact each other in a state where the toner on the paper P is heated and is softened, roller marks are to be formed.

In FIG. 2, functional structure of the image forming apparatus 100 is shown.

The image forming apparatus 100 includes an image control section 1A, a scanner section 20, an image forming section 30, an operation display section 4, a fixing unit 50, a printer controller 60 and a power switch 70.

The image control section 1A includes a control section 1, a storage section 2, a reading process section 3, a writing process section 41, a DRAM (Dynamic Random Access Memory) control IC 5, a compression IC 6, an expansion IC 7 and an image memory 8.

The control section 1 includes a CPU, a RAM, a ROM and the like which are not shown.

The control section 1 expands various types of programs which are stored in the ROM or in the storage section 2 in the RAM by the CPU and integrally controls the operation of the image forming apparatus 100 by cooperating with the expanded various types of programs.

The storage section 2 includes a non-volatile memory and the like, and the storage section 2 stores a system program or various types of programs and the like.

The reading process section 3 inputs the electronic signal which is outputted from the scanner section 20 and carries out various types of image processes such as an analog signal process, an A/D conversion process, a shading correction and the like to the inputted electronic signal to generate digital image data.

The reading process section 3 outputs the generated image data to the compression IC 6.

The writing process section 41 inputs the image data which is outputted from the expansion IC 7 and generates a PWM (Pulse Width Modulation) signal based on the inputted image data.

The writing process section 41 outputs the generated image data to the image forming section 30.

The DRAM control IC 5 controls the compression process of the compression IC 6 and the expansion process of the expansion IC 7.

Further, the DRAM control IC 5 inputs the image data which is stored in the compression memory of the image memory 8 or outputs the image data which is stored in the page memory of the image memory 8.

The compression IC 6 inputs the image data which is outputted from the reading process section 3, carries out compression process to the inputted image data and outputs the image data to which the compression process is already carried out to the DRAM control IC.

The expansion IC 7 inputs the image data which is outputted from the DRAM control IC, carries out expansion process to the inputted image data and outputs the image data to which the expansion process is already carried out to the writing process section 41.

The image memory 8 includes a DRAM (Dynamic Random Access Memory) which is a volatile memory and includes a compression memory and a page memory. The compression memory is a memory for storing the image data to which the compression process is already carried out and the page memory is a memory for temporarily storing the image data to which the compression process is already carried out before image forming.

The scanner section 20 includes a CCD 201, a scanner control section 202 and the like.

The scanner control section 202 executes alight exposure scanning to the document D which is mounted on the platen glass and receives the reflection light from the document D by the CCD 201 to read the light signal. The scanner control section 202 generates an electric signal by carrying out an opto-electric conversion to the read light signal and outputs the generated electric signal to the reading process section 3.

The image forming section 30 includes a LD (Laser Diode) section 301, an image forming control section 302 and the like. The image forming section 30 inputs the image data which is outputted from the writing process section 41 and forms an image on the paper P based on the inputted image data.

The LD section 301 includes imaging section of each of the colors YMCK, conveyance rollers for conveying the paper P, conveyance path switching sections and the like, and the LD section 301 forms an image on the paper P.

The image forming control section 302 controls the operation of each part and each device of the LD section 301.

The operation display section 4 includes a LCD (Liquid Crystal Display) 401, an operation display control section 402, a group of operation keys (not shown) and the like.

The LCD 401 displays various types of setting screens and the like on the operation screen of the LCD. As for the various types of setting screens, for example, there are a setting screen of one-side printing/both-side printing, a setting screen for paper type/basis weight/size, a setting screen for gloss mode and the like.

The operation display control section 402 generates an operation signal when an operation key or the like is pushed and outputs the generated operation signal to the LCD to carry out display control of the LCD 401.

The fixing unit 50 includes the first fixing device 51, the second fixing device 52, the first cooling device 53, the second cooling device 54, the first conveyance path switching section 55, the second conveyance path switching section 56, the conveyance path 57, the conveyance rollers 58 and the like.

The fixing unit 50 inputs the control signal of the control section 1 and controls the operation of the above each part and each device based on the inputted control signal.

The printer controller 60 includes a controller control section 601, a DRAM control IC 602, an image memory 603, a LAN IF 604 and the like.

The controller control section 601 integrally controls the operation of each part.

The DRAM control IC 602 outputs the image data which is inputted via the LAN IF 604 to the image memory 603 or inputs the image data which is outputted from the image memory 603.

Moreover, the DRAM control IC 602 is connected with the DRAM control IC 5 of the image control unit 1A by a PCI (Peripheral Components Interconnect) bus and outputs the image data to the DRAM control IC 5.

The image memory 603 includes a DRAM and the like, and the image memory 603 inputs the image data which is outputted from the DRAM control IC and temporarily stores the inputted data.

The LAN IF 604 includes a communication interface for connecting to a network, such as a NIC (Network Interface Card), a modem and the like. The LAN IF 604 receives the image data which is transmitted from a PC which is an external terminal via the network N and outputs the received image data to the DRAM control IC 602.

The power switch 70 includes a switch to turn ON/OFF the secondary power or the main power and outputs the ON/OFF signal to the control section 1.

Figure 3:
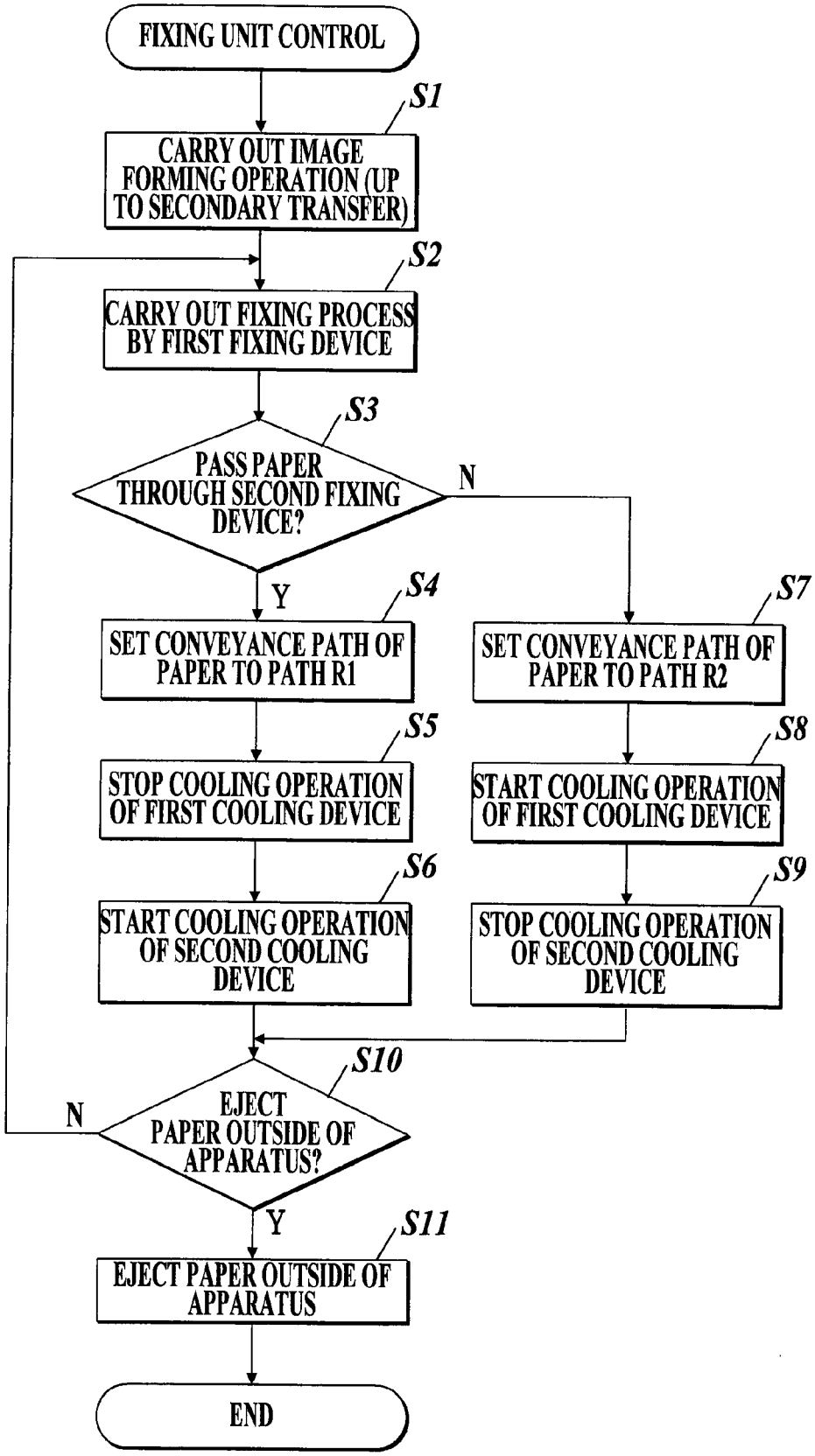
FIG. 3 is a flow chart showing a paper ejection process.

The control of the fixing unit 50 will be described with reference to FIG. 3.

The control section 1 controls the operation of the automatic document conveyance section 10, the scanner section 20, the image forming section 30, the paper feeding section 40 and the like to carry out a process of transferring (secondary transfer) the toner image of each color of YMCK to the paper P from the transfer belt B (step S1).

The control section 1 heats and pressurizes the paper P by the first fixing device 51 to fix the toner on the paper P by heat fixing (step S2).

The control section 1 determines whether to make the paper P pass the second fixing device 52 or not (step S3). In time of the determination, the control section 1 determines whether to carry out a further fixing process by the second fixing device 52 or not based on the setting information which is inputted from various types of setting screens of the operation display section 4. As described above, as for the various types of setting screens, for example, there are a setting screen of one-side printing/both-side printing, a setting screen for paper type/basis weight/size, a setting screen for gloss mode and the like. For example, when the gloss mode is set, the control section 1 determines that the paper P is to be made to pass the second fixing device 52.

When the paper P is to be made to pass the second fixing device 52 (step S3; Y), the control section 1 switches the conveyance path of the paper P to the path R1 (see FIG. 1) by the first conveyance path switching section 55 (step S4). Further, along with switching to the path R1, the control section 1 stops the cooling operation of the first cooling device 53 (step S5).

The reason for stopping the cooling operation when switching the conveyance path to the path R1 is because that a good fixation can be assured by further heating the paper P and the toner, which are heated by the first fixing device 51, by the second fixing device 52. In other wards, when the paper P and the toner which are heated by the first fixing device 51 are cooled before passing through the second fixing device 52, there is a case where a sufficient fixation cannot be obtained. Further, another reason for stopping the cooling operation is for supplying sufficient heat to the toner and to improve the gloss (gloss level) of the image.

The control section 1 starts the cooling operation of the second cooling device 54 (step S6).

When the paper P is not made to pass the second fixing device 52 (step S3; N), the control section 1 switches the conveyance path of the paper P to the path R2 by the first conveyance path switching section 55 (step S7). Along with switching to the path R2, the control section 1 starts the cooling operation of the first cooling device 53 (step S8).

The reason for starting the cooling operation when the conveyance path is switched to the path R2 is because by solidifying the toner by cooling the toner which is heated by the first fixing device 51, a roller mark, for example, can be prevented from being formed even when the path is switched by the first conveyance path switching section 55.

The control section 1 stops the cooling operation of the second cooling device 54 (step S9).

The control section 1 determines whether the paper P is to be ejected outside the apparatus or not (step S10).

When the paper P is to be ejected outside the apparatus (step S10; Y), the control section 1 ejects the paper P outside the apparatus by the path R2 or the path R11 (step S11) and finishes the control of the fixing unit 50.

When the paper P is not to be ejected outside the apparatus (step S10; N), that is, when the paper P is to be conveyed to the path R22 after the path R1 or when the paper P is to be conveyed to the path R2 and image forming is to be carried out again on the reverse side of the paper P, the control section 1 moves to step S1. The control section 1 carries out the above described processes (steps S1 to S10) after moving to step S1 and ejects the paper P outside the apparatus by the path R2 or the path R11 (step S11), and thereafter, finishes the control of the fixing unit 50.

The structure of the periphery of the fixing unit and the conveyance path of the paper will be described with reference to FIG. 4.

The paper P is conveyed to the transfer roller 37 from the paper feeding section 40. Thereafter, the toner image is transferred to the paper P from the transfer belt B (secondary transfer) and the paper P in which the toner image is transferred is conveyed to the fixing unit 50.

In the fixing unit 50, the paper P is first conveyed so as to pass through the first fixing device 51. Thereafter, the conveyance path of the paper P is switched to the path R1 or the path R2 by the first conveyance path switching section 55. As described above, the path R1 is a conveyance path to convey the paper P to the second fixing device 52 and the path R2 is a conveyance path to eject the paper P outside the apparatus or a conveyance path to convey the paper P so that image forming is to be carried out again on the reverse side of the paper P.

When the conveyance path of the paper P is to be switched to the path R1, the paper P will not be cooled by the first cooling device 53. On the other hand, when the conveyance path of the paper P is to be switched to the path R2, the paper P is cooled by the first cooling device 53 in order to prevent roller marks to be formed on the paper P.

When the conveyance path of the paper P is switched to the path R1 and when the paper P is conveyed so as to pass through the second fixing device 52, the conveyance path of the paper P is switched to the path R11 or the path R22 by the second conveyance path switching section 56. As described above, the path R11 is a conveyance path to eject the paper P outside the apparatus and the path R22 is a conveyance path to convey the paper P so that image forming is to be carried out again on the reverse side of the paper P.

When the conveyance path of the paper P is switched to either of the path R11 or the path R22, the paper P is cooled by the second cooling device 54 regardless of the path which is to be switched to. Here, the second cooling device 54 may cool the paper P at all times.

In the fixing unit 50, by conveying the paper P as described above, a sufficient fixation can be assured, gloss of the image can be improved and further, degradation of image quality by roller marks and the like can be prevented.

Structure of other periphery of the fixing unit will be described with reference to FIG. 5.

Figure 4:
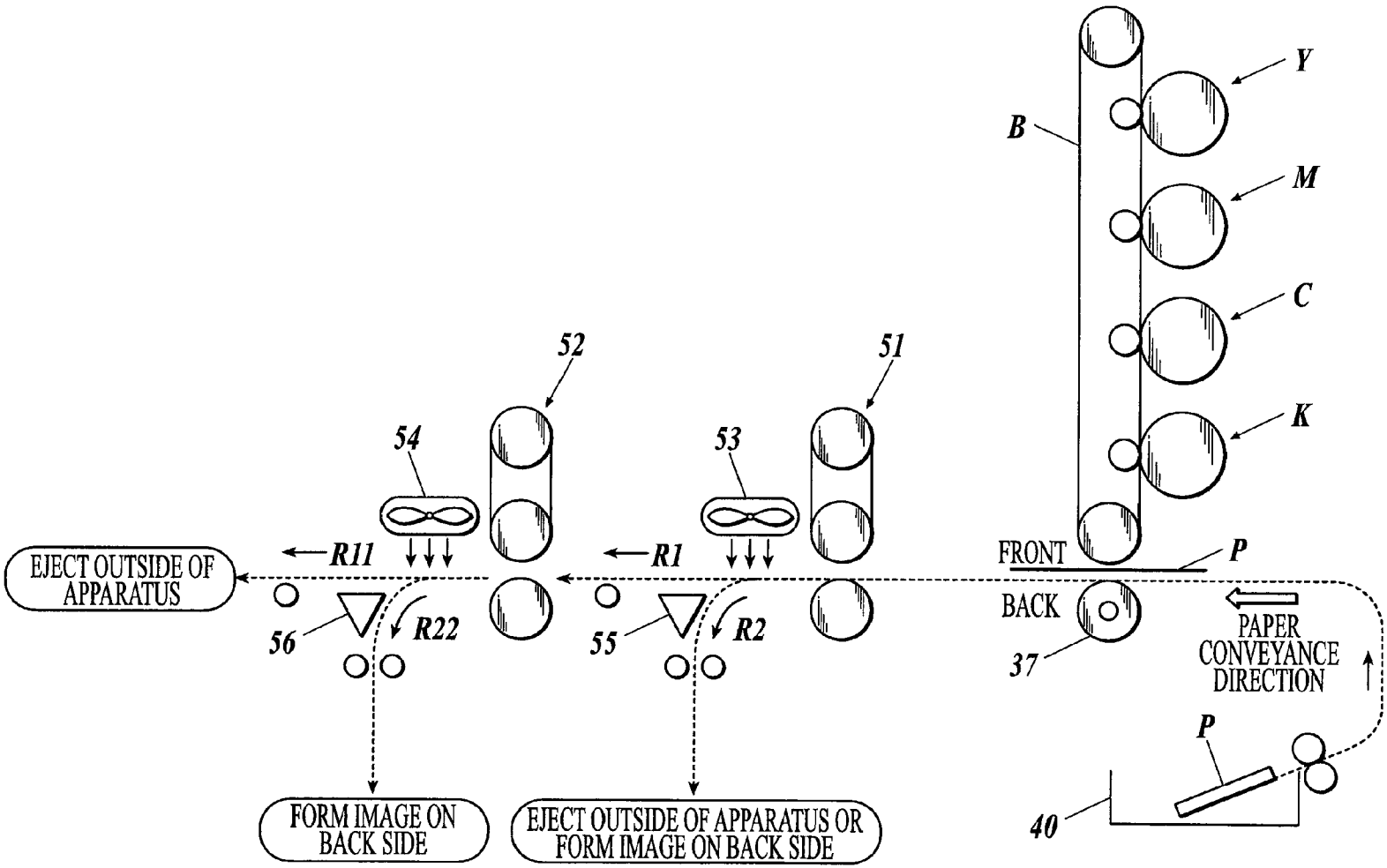
FIG. 4 is a schematic diagram of periphery of a fixing unit.
Figure 5:
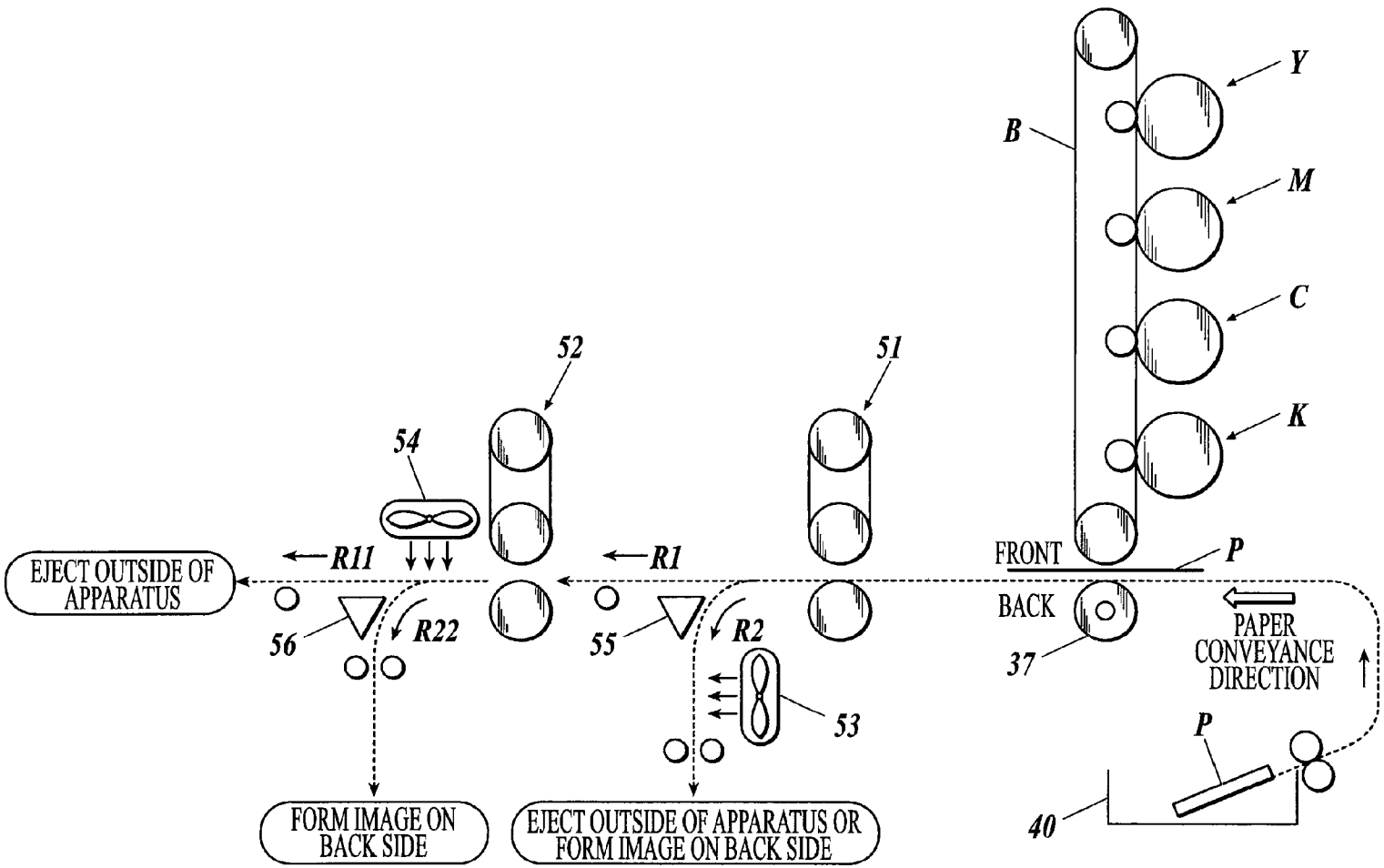
FIG. 5 is a schematic diagram of other periphery of the fixing unit.

Structure of other periphery of the fixing unit shown in FIG. 5 is different comparing to the structure shown in FIG. 4 in that the first cooling device 53 is disposed on the path R2. The structure other than the first cooling device 53 is similar to the structure shown in FIG. 4 and the conveyance path of the paper P is also same. Therefore, the descriptions will be omitted.

As shown in FIG. 5, by disposing the first cooling device 53 on the path R2 in downstream side in the paper conveyance direction than the first conveyance path switching section 55, the first cooling device 53 can be made to operate at all times even when the conveyance path of the paper P is switched to either of the path R1 or the path R2. By making the second cooling device 54 operate at all times, the control section 1 does not need to control the operations of the first cooling device 53 and the second cooling device 54 according to the conveyance path of the paper P and the control can be simplified. Here, also in the above case, power consumption can be made to be reduced by switching the operation of the cooling device according to the path of the paper P.

As described above, according to a first and a third aspects of the present invention, there is provided an image forming apparatus and an image forming system including a conveyance section to convey a paper in which a toner image which is not fixed is formed, a first fixing device to fix a toner on the paper by heat fixing, a first cooling device to cool the paper in which the toner is fixed by heat fixing, which is disposed in a downstream side in a paper conveyance direction than the first fixing device, a second fixing device to fix the toner on the paper by heat fixing, which is disposed in the downstream side in the paper conveyance direction than the first cooling device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first cooling device and the second fixing device; and a control section to control so as to carry out cooling by operating the second cooling device and not operating the first cooling device when the paper is to be conveyed to the first conveyance path and so as to carry out cooling by operating the first cooling device when the paper is to be conveyed to the second conveyance path.

The first cooling device 53 is disposed in the downstream side of the first fixing device 51 and in upstream side of the first conveyance path switching section 55. By disposing the first cooling device 53 at the above position and by controlling the cooling operation, the roller marks can be prevented from occurring on the paper P. Further, sufficient fixation can also be assured and gloss of an image can also be improved.

Preferably, the control section controls so as to cool the paper by the second cooling device after fixing the toner again on the paper by the second fixing device when the paper is conveyed to the first conveyance path.

When the conveyance path of the paper P is path R2, the toner which is fixed by heat fixing is solidified because the first cooling device 53 cools the paper P. Therefore, even when the conveyance rollers 58 contact the paper P which is in process of being conveyed, the roller marks can be prevented from occurring on the paper P.

Moreover, according to a second and a fourth aspects of the present invention, there is provided an image forming apparatus and an image forming system including a conveyance section to convey a paper in which a toner image which is not fixed is formed, a first fixing device to fix a toner on the paper by heat fixing, a second fixing device to fix the toner on the paper by heat fixing, which is disposed in a downstream side in a paper conveyance direction than the first fixing device, a second cooling device to cool the paper in which the toner is fixed by heat fixing, which is disposed in the downstream side in the paper conveyance direction than the second fixing device, a conveyance path switching section to switch a conveyance path of the paper between a first conveyance path for conveying the paper to the second fixing device and a second conveyance path in which the conveyance direction of the paper is switched by a switching member, which is disposed between the first fixing device and the second fixing device, a first cooling device to cool the paper in which the toner is fixed by heat fixing, which is disposed in the downstream side in the paper conveyance direction than the conveyance path switching section of the second conveyance path and a control section to control so as to carry out cooling by operating the second cooling device when the paper is to be conveyed to the first conveyance path and so as to carry out cooling by operating the first cooling device when the paper is to be conveyed to the second conveyance path.

The first cooling device 53 may be disposed in the downstream side of the first conveyance path switching section 55 on the path R2. In such case, the first cooling device 53 is made to be operated at all times and the control can be simplified.

Further, preferably, the switching member is a nail member for switching the conveyance direction of the paper by contacting the paper and/or a roller member for feeding the paper.

Furthermore, preferably, the first cooling device and the second cooling device cool the paper by a rotational operation of a fan, and the control section controls a cooling operation of the first cooling device or the second cooling device by driving or stopping the rotational operation of the fan.

The first cooling device 53 is constituted with a fan, and the control section 1 can control cooling/not-cooling by controlling the rotational operation of the fan.

The present U.S. patent application claims a priority under the Paris Convention of Japanese paten application No. 2009-235046 filed on Oct. 9, 2009, which shall be a basis of correction of an incorrect translation.

What is claimed is:

1. An image forming apparatus, comprising:

a conveyance section to convey a paper in which a toner image which is not fixed is formed;

a first fixing device to fix a toner on the paper by heat fixing;

a first cooling device to cool the paper on which the toner is fixed by heat fixing, the first cooling device being disposed downstream of the first fixing device in a paper conveyance direction;

a second fixing device to fix the toner by heat fixing on a same face of the paper as the first fixing device fixes the toner, the second fixing device being disposed downstream of the first cooling device in the paper conveyance direction;

a second cooling device to cool the paper on which the toner is fixed by heat fixing, the second cooling device being disposed downstream of the second fixing device in the paper conveyance direction;

a conveyance path switching section to switch a conveyance path of the paper between a first conveyance path for conveying the paper to the second fixing device and a second conveyance path in which the conveyance direction of the paper is switched by a switching member, the conveyance path switching section being disposed between the first cooling device and the second fixing device; and a control section which performs control to carry out: (i) fixing by operating the first and second fixing devices, and cooling by operating the second cooling device and not operating the first cooling device, when the paper is to be conveyed to the first conveyance path, and (ii) fixing by operating the first fixing device and not operating the second fixing device nor the second cooling device, and cooling by operating the first cooling device, when the paper is to be conveyed to the second conveyance path.

2. The image forming apparatus of claim 1, wherein the control section controls so as to cool the paper by the second cooling device after fixing the toner again on the paper by the second fixing device when the paper is conveyed to the first conveyance path.

3. The image forming apparatus of claim 1, wherein the switching member is a nail member for switching the conveyance direction of the paper by contacting the paper and/or a roller member for feeding the paper.

4. The image forming apparatus of claim 1, wherein the first cooling device and the second cooling device cool the paper by a rotational operation of a fan, and the control section controls a cooling operation of the first cooling device or the second cooling device by driving or stopping the rotational operation of the fan.

5. An image forming apparatus, comprising:

a conveyance section to convey a paper in which a toner image which is not fixed is formed;

a first fixing device to fix a toner on the paper by heat fixing;

a second fixing device to fix the toner by heat fixing on a same face of the paper as the first fixing device fixes the toner, the second fixing device being disposed downstream of the first fixing device in a paper conveyance direction;

a second cooling device to cool the paper on which the toner is fixed by heat fixing, the second cooling device being disposed downstream of the second fixing device in the paper conveyance direction;

a conveyance path switching section to switch a conveyance path of the paper between a first conveyance path for conveying the paper to the second fixing device and a second conveyance path in which the conveyance direction of the paper is switched by a switching member, the conveyance path switching section being disposed between the first fixing device and the second fixing device;

a first cooling device to cool the paper on which the toner is fixed by heat fixing, the first cooling device being disposed on the second conveyance path downstream of the conveyance path switching section in the paper conveyance direction; and a control section which performs control to carry out: (i) fixing by operating the first and second fixing devices, and cooling by operating the second cooling device and not operating the first cooling device, when the paper is to be conveyed to the first conveyance path, and (ii) fixing by operating the first fixing device and not operating the second fixing device nor the second cooling device, and cooling by operating the first cooling device, when the paper is to be conveyed to the second conveyance path.

6. The image forming apparatus of claim 5, wherein the switching member is a nail member for switching the conveyance direction of the paper by contacting the paper and/or a roller member for feeding the paper.

7. The image forming apparatus of claim 5, wherein the first cooling device and the second cooling device cool the paper by a rotational operation of a fan, and the control section controls a cooling operation of the first cooling device or the second cooling device by driving or stopping the rotational operation of the fan.

8. An image forming system, comprising:

a conveyance section to convey a paper in which a toner image which is not fixed is formed;

a first fixing device to fix a toner on the paper by heat fixing;

a first cooling device to cool the paper on which the toner is fixed by heat fixing, the first cooling device being disposed downstream of the first fixing device in a paper conveyance direction than the first fixing device;

a second fixing device to fix the toner by heat fixing on a same face of the paper as the first fixing device fixes the toner, the second fixing device being disposed downstream of the first cooling device in the paper conveyance direction;

a second cooling device to cool the paper on which the toner is fixed by heat fixing, the second cooling device being disposed downstream of the second fixing device in the paper conveyance direction;

a conveyance path switching section to switch a conveyance path of the paper between a first conveyance path for conveying the paper to the second fixing device and a second conveyance path in which the conveyance direction of the paper is switched by a switching member, the conveyance path switching section being disposed between the first cooling device and the second fixing device; and a control section which performs control to carry out: (i) fixing by operating the first and second fixing devices, and cooling by operating the second cooling device and not operating the first cooling device, when the paper is to be conveyed to the first conveyance path, and (ii) fixing by operating the first fixing device and not operating the second fixing device nor the second cooling device, and cooling by operating the first cooling device, when the paper is to be conveyed to the second conveyance path.

9. The image forming system of claim 8, wherein the control section controls so as to cool the paper by the second cooling device after fixing the toner again on the paper by the second fixing device when the paper is conveyed to the first conveyance path.

10. The image forming system of claim 8, wherein the switching member is a nail member for switching the conveyance direction of the paper by contacting the paper and/or a roller member for feeding the paper.

11. The image forming system of claim 8, wherein the first cooling device and the second cooling device cool the paper by a rotational operation of a fan, and the control section controls a cooling operation of the first cooling device or the second cooling device by driving or stopping the rotational operation of the fan.

12. An image forming system, comprising:

a conveyance section to convey a paper in which a toner image which is not fixed is formed;

a first fixing device to fix a toner on the paper by heat fixing;

a second fixing device to fix the toner by heat fixing on a same face of the paper as the first fixing devices fixes the toner, the second fixing device being disposed downstream of the first fixing device in a paper conveyance direction;

a second cooling device to cool the paper on which the toner is fixed by heat fixing, the second cooling device being disposed downstream of the second fixing device in the paper conveyance direction;

a conveyance path switching section to switch a conveyance path of the paper between a first conveyance path for conveying the paper to the second fixing device and a second conveyance path in which the conveyance direction of the paper is switched by a switching member, the conveyance path switching section being disposed between the first fixing device and the second fixing device;

a first cooling device to cool the paper on which the toner is fixed by heat fixing, the first cooling device being disposed on the second conveyance path downstream of the conveyance path switching section in the paper conveyance direction; and a control section which performs control to carry out: (i) fixing by operating the first and second fixing devices, and cooling by operating the second cooling device and not operating the first cooling device, when the paper is to be conveyed to the first conveyance path, and (ii) fixing by operating the first fixing device and not operating the second fixing device nor the second cooling device, and cooling by operating the first cooling device, when the paper is to be conveyed to the second conveyance path.

13. The image forming system of claim 12, wherein the switching member is a nail member for switching the conveyance direction of the paper by contacting the paper and/or a roller member for feeding the paper.

14. The image forming system of claim 12, wherein the first cooling device and the second cooling device cool the paper by a rotational operation of a fan, and the control section controls a cooling operation of the first cooling device or the second cooling device by driving or stopping the rotational operation of the fan.

* * * * *